US006712640B2

(12) United States Patent
Ferderer

(10) Patent No.: US 6,712,640 B2
(45) Date of Patent: Mar. 30, 2004

(54) CONNECTING ARRANGEMENT

(75) Inventor: Albert Ferderer, Espelkamp (DE)

(73) Assignee: Harting Electric GmbH & Co. KG (DE)

( * ) Notice: Subject to any disclaimer, the term of this patent is extended or adjusted under 35 U.S.C. 154(b) by 0 days.

(21) Appl. No.: 10/163,932

(22) Filed: Jun. 6, 2002

(65) Prior Publication Data

US 2003/0060077 A1 Mar. 27, 2003

(30) Foreign Application Priority Data

Jun. 13, 2001 (DE) ..... 101 28 691

(51) Int. Cl.[7] ..... H01R 4/24; H01R 4/26; H01R 11/20

(52) U.S. Cl. ..... 439/409

(58) Field of Search ..... 439/404, 409, 439/410

(56) References Cited

U.S. PATENT DOCUMENTS

| | | | |
|---|---|---|---|
| 4,759,726 A | 7/1988 | Naylor et al. | 439/441 |
| 5,368,501 A | 11/1994 | Asbell | 439/418 |
| 5,704,801 A | 1/1998 | Walker et al. | 439/417 |
| 6,036,532 A | 3/2000 | Feistkorn | 439/495 |

FOREIGN PATENT DOCUMENTS

| | | |
|---|---|---|
| DE | 24 54 212 | 11/1974 |
| DE | 195 16 338 C1 | 5/1995 |
| DE | 196 05 083 | 9/1996 |
| DE | 199 11 415 A 1 | 3/1999 |
| EP | 0 824 767 B1 | 6/1999 |

*Primary Examiner*—Javaid H. Nasri
(74) *Attorney, Agent, or Firm*—Hayes Soloway P.C.

(57) ABSTRACT

For a connection between two multiple electrical conductors, a connecting arrangement is proposed which consists of a casing that can be disassembled in such a way that even a multiple electrical conductor that has already been laid, for example a round cable, can be connected to additional electrical conductors at any desired point. Under these circumstances, electrical contact with the individual electrical conductors of the multiple conductor that has been laid is made by means of insulation-cutting terminals disposed in the said casing in which an eccentric, which is likewise disposed therein in a rotatable manner, successively forces the electrical conductors, without great expenditure of force, into the insulation-cutting terminals disposed in the form of a circle around the eccentric, and brings them into electrical contact with the severing of the insulation.

16 Claims, 7 Drawing Sheets

CONNECTING ARRANGEMENT

FIELD OF THE INVENTION

The invention relates to a connecting arrangement for connecting individual electrical conductors of a multiwire lead to circuit-extending electrical conductors, the said connecting arrangement consisting of an insulating casing which is formed from parts that can be connected to one another, a central aperture being provided and contact elements, which are disposed inside the casing and have insulation-cutting terminals, being provided for contact-making purposes.

A connecting arrangement of this kind is used for severable, electrically conductive connection to other electrical consumers in an already existing industrial, electrical supply system.

BACKGROUND OF THE INVENTION

It is known practice to make electrical contact between electrical conductors by means of the insulation-cutting terminating technique. From DE 196 05 083 A1, a cable-connecting arrangement is known, in which an electrical connection from a subscriber's lead to a printed-circuit board takes place in a modular casing, this being achieved with the aid of an assembly consisting of a perforated disc, a casing and insulation-cutting terminating contacts and integrated into a modular casing.

A disadvantageous consequence in that instance is that, as a rule,.a number of electrical conductors are forced into the insulation-cutting terminals at the same time, it being necessary to overcome major forces for severing the insulation, which forces have to be applied by the user and transmitted to the insulation-cutting terminals via the material.

Another known electrical type of connection by means of the so-called "piercing technique", in which metal points bore through the sheath into the electrically conductive conductor, is also ruled out, since connections of this kind either cannot be applied, or can be applied only under certain conditions, in the industrial environment.

SUMMARY OF THE INVENTION

The underlying object of the invention is therefore to construct a connecting technique of the initially mentioned type which is cost-effective and can be manipulated quickly, for industrial wiring technology, to the effect that it is possible to make electrical contact with a plurality of electrical conductors in a simple and force-saving working operation by means of insulation-cutting terminals, there being provided, at the same time, the possibility of connection to already existing multiwire leads without interrupting the latter.

This object is achieved through the fact that there are provided, in a first part of the casing, contact elements which are disposed in the form of a circle and at intervals and which have insulation-cutting terminals, the apertures of the said insulation-cutting terminals pointing towards the centre of the aperture; that a rotatable, cylindrical insert has a peg on which an eccentric is constructed; that the individual conductors are disposed in the form of a circle round the said insert in the axial direction and are pushed, together, into the aperture in the connecting arrangement; and that, when the peg is rotated, the eccentric exerts a radially acting force on the individual conductors, the latter being forced one after another into the apertures in the insulation-cutting terminals.

Whereas, in domestic wiring, work is predominantly carried out with flat-strip cables which are laid under plaster, in industrial wiring technology, use is preferably made of round cables with a number of individual wires, which are predominantly laid in cable ducts or cable shafts. Connection to the said individual wires is, as a rule, possible only at branching points which are provided for that purpose.

The advantages achieved by means of the invention consist, in particular, in the fact that it is even possible to carry out, independently of any branching point which has already been provided, electrical connections to an existing round cable which has already been laid and which consists of a number of individual electrical conductors, since the casing, according to the invention, of the connecting arrangement is produced from two parts which can be separated in such a way that an electrical lead which has not been severed can be encompassed and can be connected, in the interior of the casing, to a circuit-extending, branching electrical lead.

Also of advantage is the fact that an electrical connection is produced in a problem-free and force-saving manner through the use of an eccentric inside the connecting arrangement, the separated electrical conductors each being forced, one after another, into the cutting edges of insulation-cutting terminating contacts, so that, when severing the insulation, only the force for one electrical conductor at a time is required.

In one embodiment, the casing parts are preferably connected with the aid of a so-called "T-groove guide", however other linear guides may also be employed.

In addition, provision is made for implementing the mechanical holding-together of the two casing parts in an advantageous manner, only by means of one further component, a semicircular curved element, which is placed inside the casing in such a way that, although the two casing parts are fixedly connected to one another mechanically, they can nevertheless be detached again.

At the same time, the said curved element advantageously serves to hold the contact elements, which have insulation-cutting terminals on one side and, on the other side, connecting ends onto which the electrical conductors leading in or away can be slipped, again by means of slip-on contacts. An advantageous disposition of the electrical conductors in the interior of the casing lies in their peripheral distribution over a semicircle in corresponding clearances in an insert which is cylindrical as a whole and which can be inserted in a central aperture in the casing.

The insert represented in the form of embodiment advantageously has an eccentric, onto either side of which a peg is moulded, there being pushed onto each peg rotatable circular ring elements in which the separated electrical conductors are placed in moulded-in clearances. When the insert is pushed into the central aperture, the electrical conductors in the clearances of the circular ring elements have corresponding clearances in a first part of the casing lying opposite them, so that the said electrical conductors pass into the said clearances as soon as the insert has been inserted, and directly adjoin the insulation-cutting terminals. If the eccentric is twisted by rotation of the peg by means of a simple tool, for example a screwdriver, the electrical conductors are progressively forced in an advantageous manner, individually and without the exertion of a great deal of force, into the insulation-cutting terminals which are disposed at intervals and side by side in the form of a ring.

In another advantageous form of embodiment, the components required are further reduced, so that an additional reduction in costs and assembly time can be achieved. In this instance, the abovementioned two casing parts have been combined to form a one-piece casing in the form of an axially slit hollow cylinder, which is covered by a circular element serving as a closure. The rotatable insert has been advantageously designed in one piece, so that the circular ring elements, as already described above, have been eliminated.

BRIEF DESCRIPTION OF THE DRAWINGS

An exemplified embodiment of the invention is represented in the drawings and will be explained in greater detail below. In the said drawings.

DETAIL DESCRIPTION OF THE INVENTION

Figure 1:
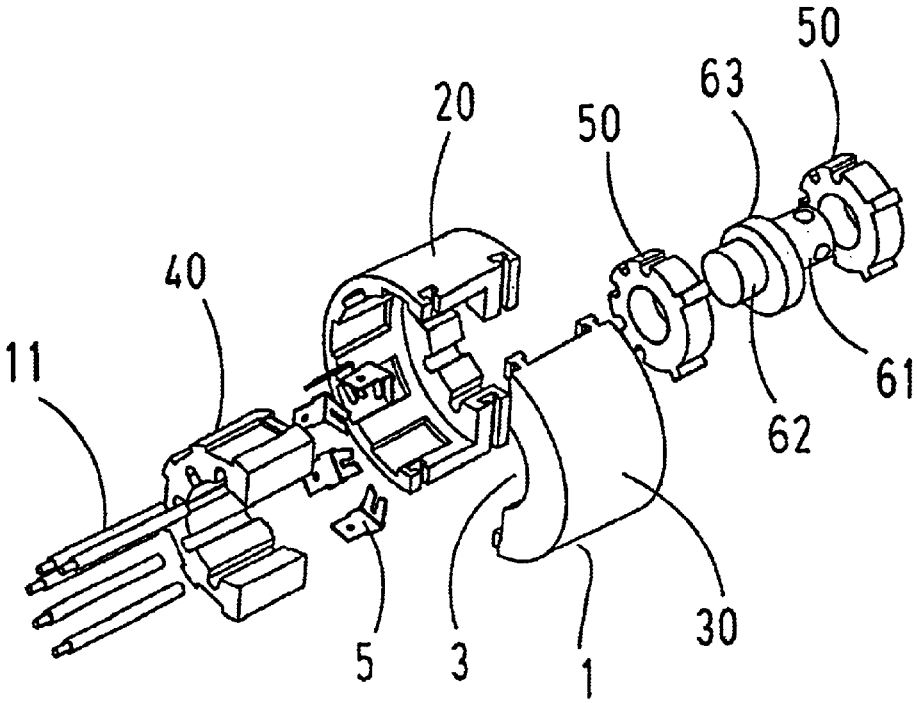
FIG. 1 shows an exploded perspective drawing of the connecting arrangement.

In FIG. 1, the various components of a connecting arrangement, which can be inserted in one another, are represented in an exploded view. In this figure, it is possible to make out a casing 1 which is formed from two semicircular segments, parts 20, 30, and is designed, as a whole, as a round body, and in the middle of which a central aperture 3 is provided. A cylindrical, rotatable insert 60 can be inserted in the said aperture.

Also provided is a semicircular curved element 40, by means of which the two parts 20, 30 are held together mechanically. The said parts 20, 30 are not symmetrical but are divided outside their theoretical middle, so that the part 20 reaches slightly beyond the said middle line, whereas the part 30 is of slightly shorter design. At their dividing faces 21, 31, which extend in the axial direction, the segment-like parts have guide elements 22, 32 which, in this example, are constructed as a T-groove guide. However, variants of a different kind of guide can also be conceived of. In addition, provision is made (but not shown here) for the guides to be of different construction in order to achieve confusion-proof coding. By means of the said guides, the parts are, first of all, held together against falling apart, however they are still displaceable in relation to one another. In order to avoid displacement, the semicircular curved element 40 is pushed into the central aperture 3. Under these circumstances, the curved element interlocks the two parts 20, 30 and the casing now formed represents a mechanically stable body.

Figure 2:
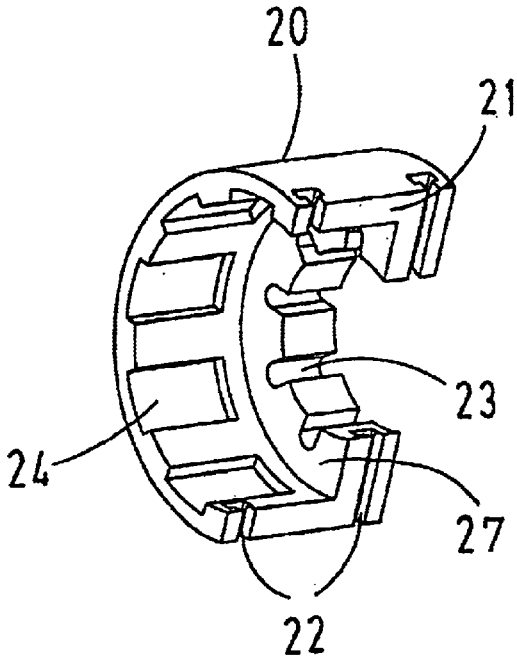
FIG. 2 shows a perspective view of a first casing part.

FIG. 2 shows the segment-like part 20, with clearances 23 inside the offset 27 for the individual conductors 11 to be received, which clearances point towards the central aperture. For the purpose of contact-making between the connecting ends 7 (shown in FIG. 8) and a slip-on contact 100 (shown in FIG. 8), clearances 24 are moulded in on the inner side of the wall in the axial direction of the part 20, which clearances combine with clearances 44 in the curved element to form a chamber into which the slip-on contacts with the additional electrical conductors 15 can be pushed.

Figure 3:
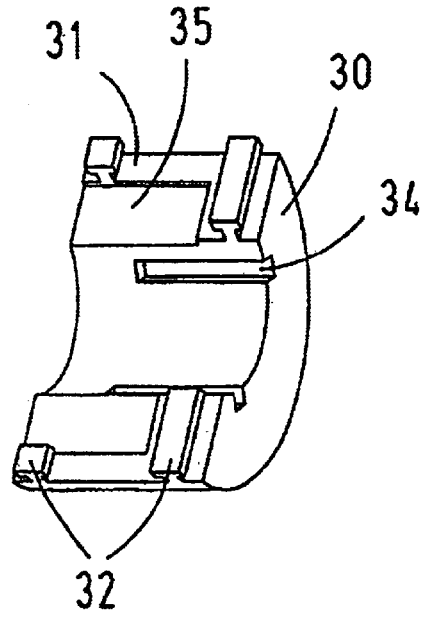
FIG. 3 shows a perspective view of a second casing part.

The part 30, which is represented in FIG. 3, likewise represents a partial circular segment, on each of whose dividing faces 31 there are provided two T-guides 32 which belong to the T-grooves in the part 20. In that connection, the T-guides are provided, in one case, over the entire dividing face and, in the other, in a shortened form, in a manner corresponding to the shaping of the part 30. An additional undercut 35 in a partial region of the wall of the part 30, into which undercut the curved element 40 projects with its sectional faces 45, diminishes the transmission of force onto the guiding means 22, 32, if an attempt is made to push the joined-together parts 20, 30 apart sideways without removing the curved element 40 beforehand.

Figure 4:
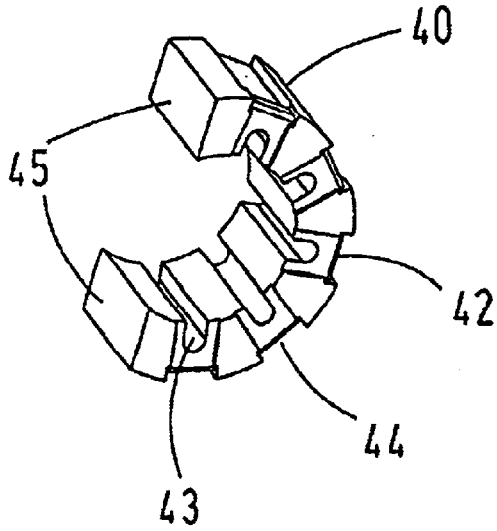
FIG. 4 shows a perspective view of a curved element.

However the curved element 40, which is shown in FIG. 4, has yet another function, in that the contact elements 5 are disposed and fixed, in the form of a circle, in the depressions 42. When the curved element is put in, the contact elements are also inserted in the part 20. In addition, there are moulded into the curved element, in the outer region, clearances 43 which form, in conjunction with the clearances 23 on the inner wall in the part 20, chambers into which the connecting ends 7 of the contact elements project and into which slip-on contacts with electrical conductors 15 fixed thereto are also introduced and pushed onto the connecting ends 7. That inner region of the curved element 40 which points into the central aperture 3 additionally has a clearance 43 which represents a prolongation of the clearances 23 moulded into the offset region 27 of the part 20. The individual conductors 11 are guided, when the insulation-cutting terminals 6 make contact with them, into the said axially coinciding clearances.

Figure 5A:
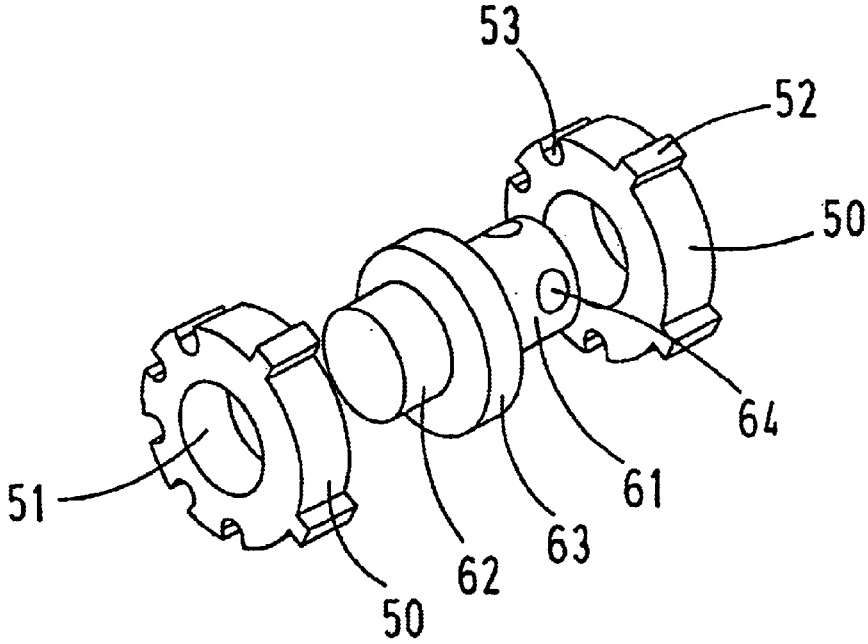
FIG. 5*a* shows a perspective view of an insert.
Figure 5B:
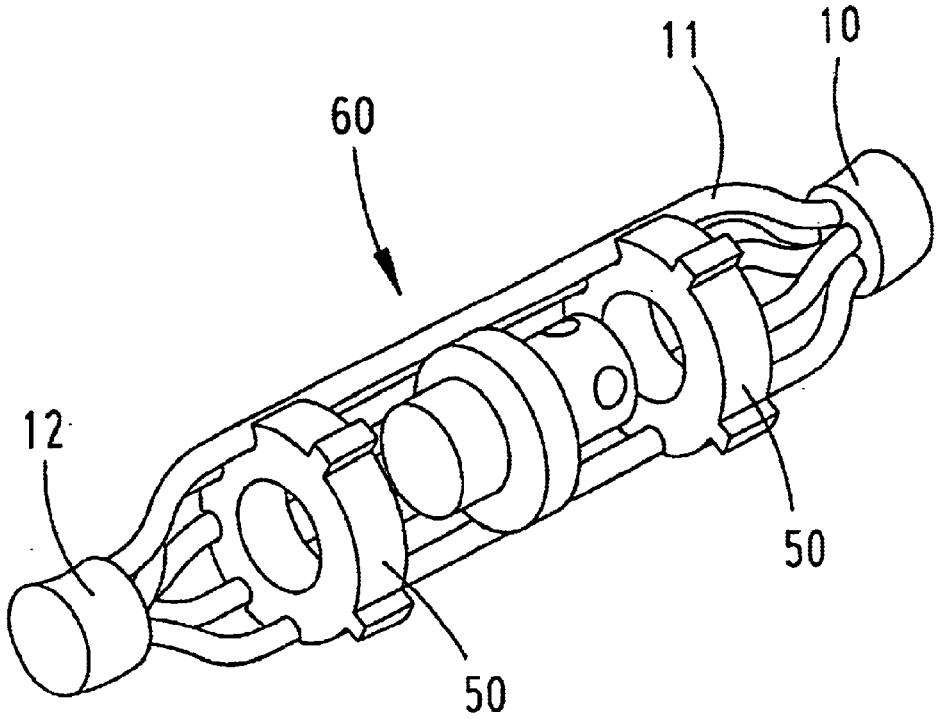
FIG. 5*b* shows a perspective view of the insert with individual electrical conductors surrounding it.

The cylindrical insert 60, which is to be inserted, with the circular ring elements 50 disposed thereon, in the central aperture in the casing, is represented in FIG. 5. The insert consists of the two pegs 61, 62 and a moulded-on eccentric ring 63, and also of two circular ring elements 50 which are identical in their form of embodiment and which are pushed onto the pegs on either side of the eccentric ring and in such a way as to be rotatable independently of the latter. The circular ring elements 50 have, moulded into them peripherally, semicircular clearances 53 which are provided for the purpose of receiving the individual conductors 11, and also, moulded onto the said segments, noses 52 which engage in corresponding clearances 34 in the part 30 and thus prevent twisting of the circular ring elements after insertion in the central aperture in the casing.

After assembly, the peg 61 projects beyond the externally located circular ring element and contains, in this projecting part, two transverse bores 64 which are incorporated crosswise and into which a tool can be introduced in order to rotate the peg with the eccentric ring. Provision is also made for bringing the two circular ring elements into coincidence of their position relative to one another by a catching action, which can be easily overcome in the direction of rotation, between the peg and the circular ring elements.

Figure 6:
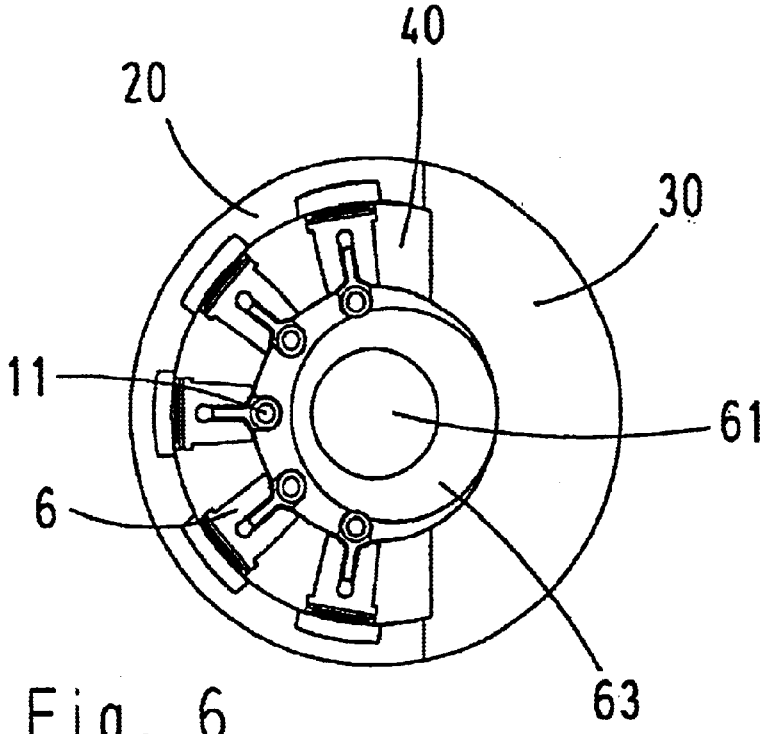
FIG. 6 shows a plan view of the casing plane of the insulation-cutting terminals with a position of the eccentric in which there is no contact-making between the insulation-cutting terminals and the electrical conductors.
Figure 7:
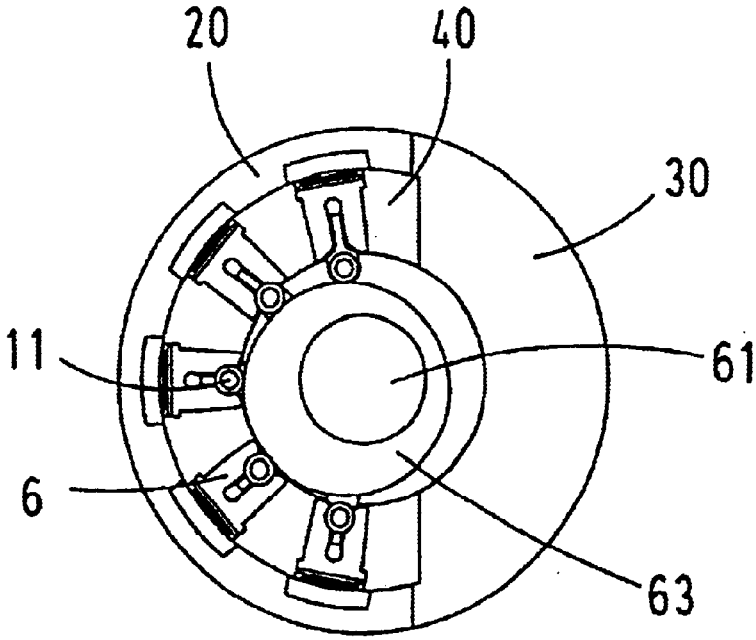
FIG. 7 shows a plan view of the casing plane of the insulation-cutting terminals with a position of the eccentric in which there is partial contact-making between the electrical conductors and the insulation-cutting terminals.

The mode of functioning and operation of the insert 60 with the eccentric ring 63 is represented in FIGS. 6 and 7, namely in the form of a plan view in the region of the insulation-cutting terminals and of the eccentric ring. In the said FIGS., FIG. 6 reproduces the starting position in which the cylindrical insert 60 is fitted with the individual conductors 11, which are laid in the clearances 53 in the circular ring elements 50.

If the eccentric is rotated, as shown in FIG. 7, the individual conductors 11, which are initially inserted in the peripheral clearances 53 in the circular ring elements 50, are moved radially outwards in the direction of the part 20 having the correspondingly associated clearances 23 and also the insulation-cutting terminals 6 contained therein. In the process, the electrical conductors are successively forced between the cutting edges of the insulation-cutting terminals, the insulation being cut and contact-making taking place between the electrical contact and the insulation-cutting terminal. The eccentric is rotated by means of a simple tool, such as a screwdriver for example, which is slipped into the transverse bores which are moulded crosswise into the projecting part of the peg.

Figure 8:
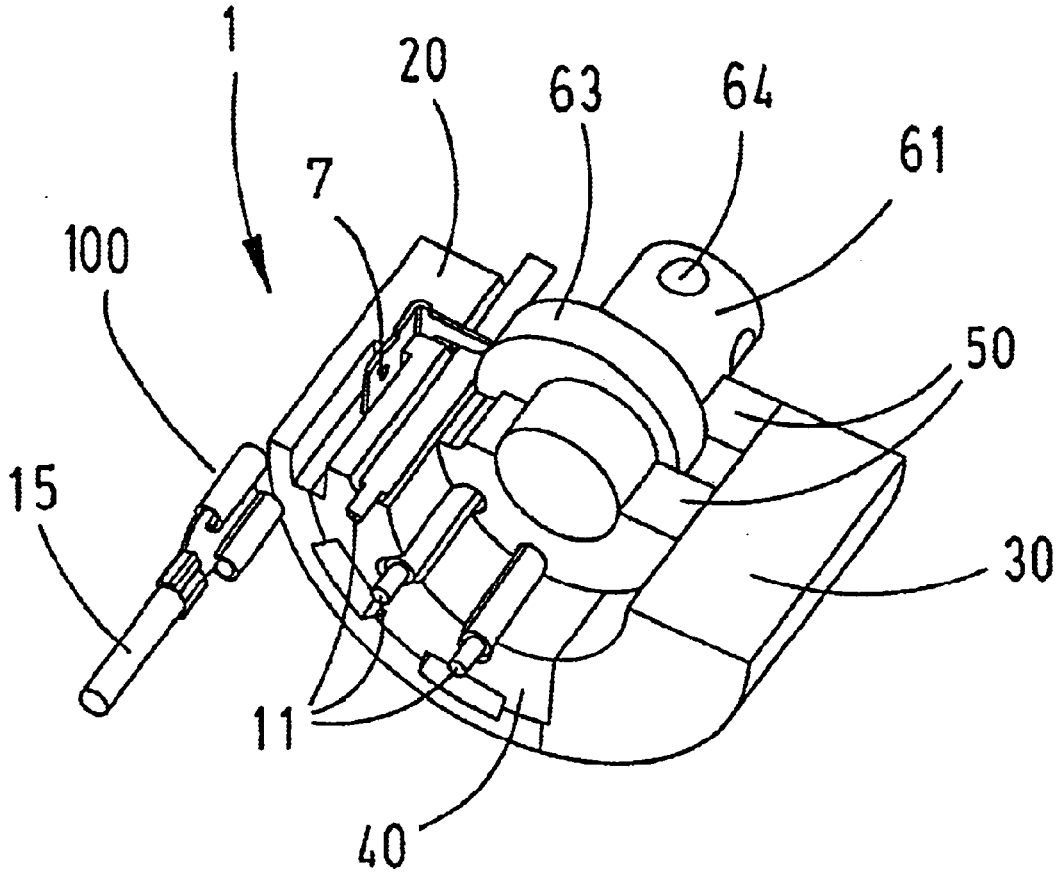
FIG. 8 shows a perspective axial section through an assembled connecting arrangement.

In the course of the assembly of the connecting arrangement, as has already taken place in FIG. 8, in order to achieve a branching connection to the electrical conductors 15 from or to a multiwire lead which has already been laid, the sheathing 12 is removed at a suitable point in the case of a round cable which, as a rule comprises a number of individual conductors, and the said individual conductors 11 are pulled apart.

The casing of the connecting arrangement is disassembled, through the fact that the insert 60 inserted in the central aperture 3, and also the curved element 40, are first of all removed and the two parts 20, 30 are displaced, counter to one another, in their guides 22, 32 until they are separated. The individual conductors 11 are then laid in the coinciding clearances 53 in the circular ring elements 50, the eccentric 63 being twisted in such a way that its minimal distance from the electrical conductors lies in the region of the clearances 53, so that the said electrical conductors can be put in without any difficulty in the appropriate manner. The parts 20, 30 are then placed round the individual conductors of the round cable and pushed together.

The curved element 40, in which the contact elements are held, is then inserted in the central aperture 3 in order to lock the two parts, and finally the insert 60, with the individual conductors disposed around it, is pushed into the central aperture in the casing in such a way that the noses 52 on the circular ring elements 50 engage in the clearances 34 in the part 30 and are thus fixed in the casing. Finally, the electrical conductors are forced into the insulation-cutting terminals by putting a tool into the transverse bores 64 in the peg 61 projecting out of the casing and by the twisting of the said peg in relation to the casing as a result of the action, which has been described earlier, of the co-rotating eccentric. In this example, the electrical conductors 15 which are to be branched out of the connecting arrangement will be pushed by means of cable shoes onto the connecting ends 7 of the contact elements 5, which connecting ends are disposed in chambers.

Figure 9:
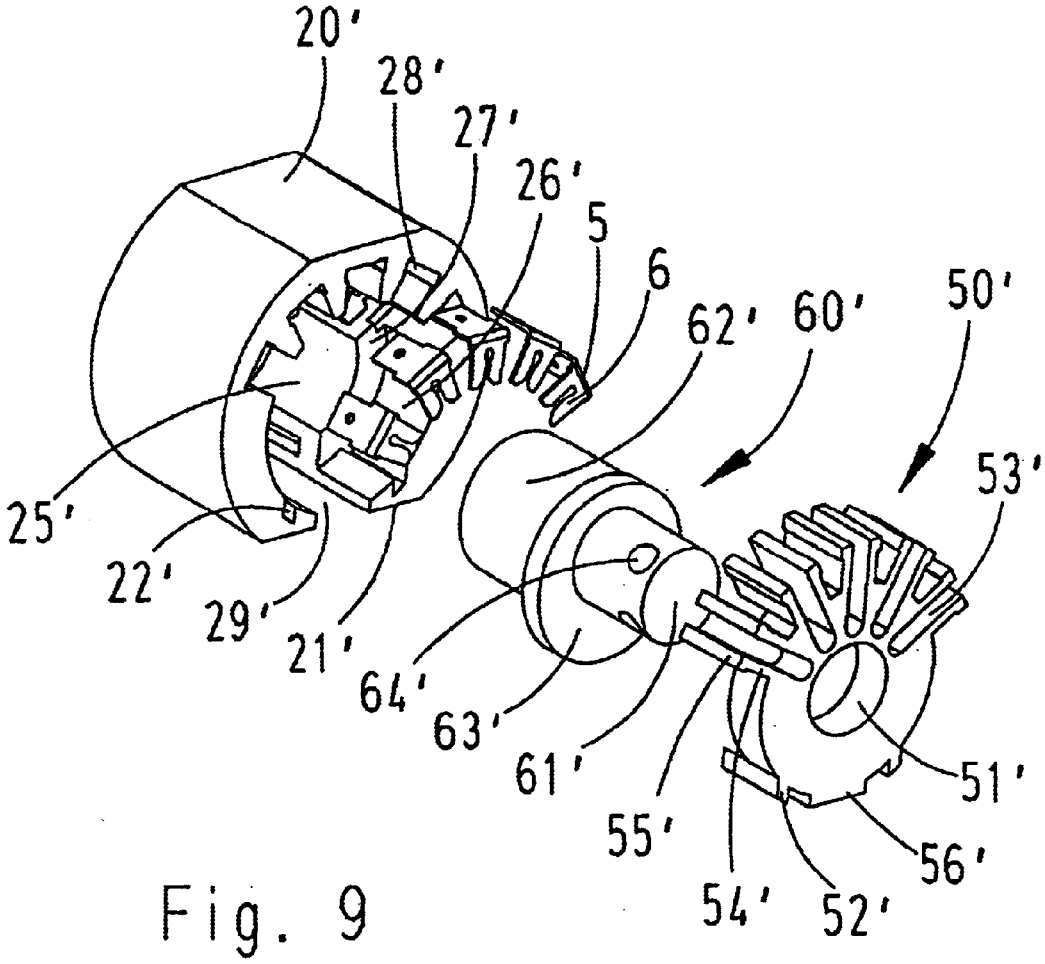
FIG. 9 shows a pulled-apart representation of a variant of the connecting arrangement, viewed from a circular ring element.
Figure 10:
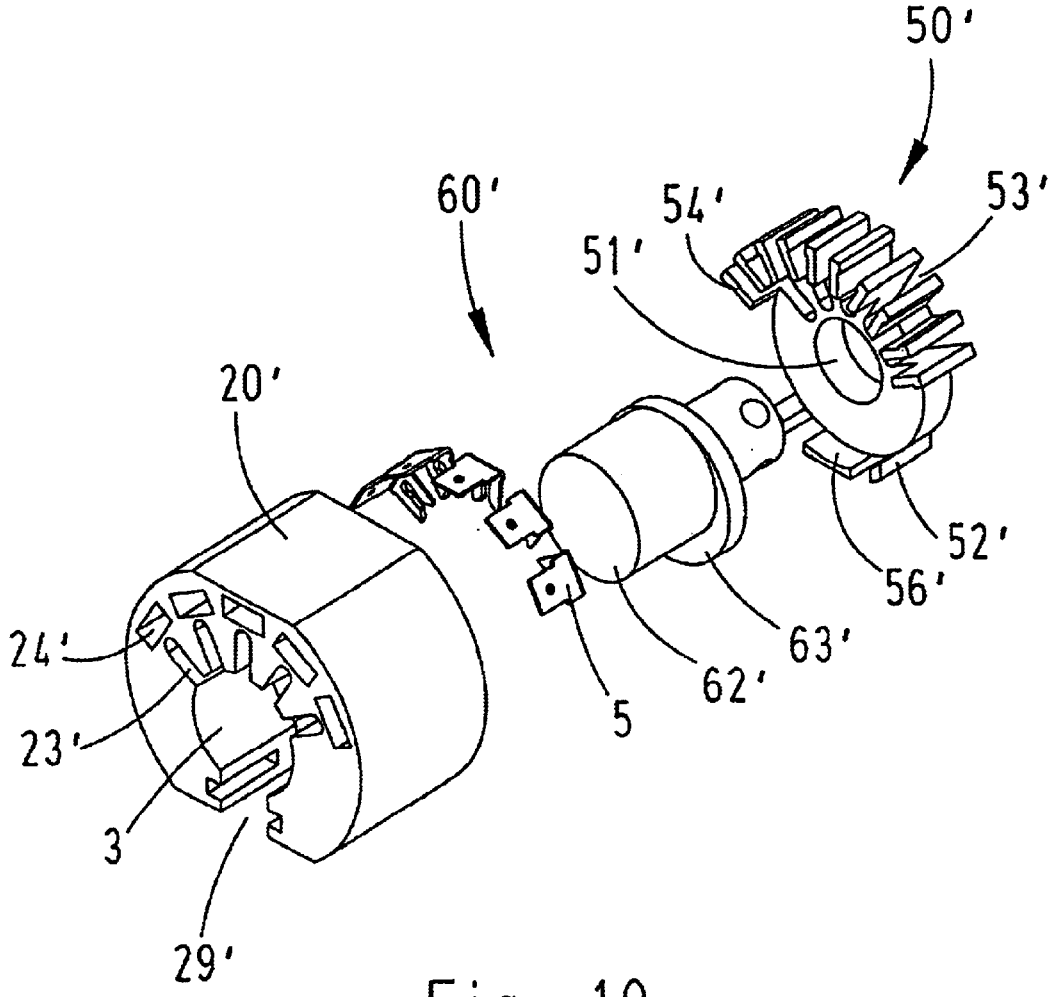
FIG. 10 shows another view of the connecting arrangement, viewed from the slit hollow cylinder.

FIGS. 9 and 10 show a variant of the above described connecting arrangement, in which there is shown a first part 20' which is designed as a hollow cylinder and has, for the purpose of inserting the multiwire lead 10, a longitudinal slit 29', an aperture 3 in which the insert 60' can be inserted, and also a circular ring element 50' which is pushed axially into the part 20' and locked therein.

The contact elements 5 are inserted in chambers 24 in a self-retaining manner and so as to point, with their insulation-cutting terminals 6, towards the centre of the aperture. The circular ring element 50' is provided with a middle bore 51' for receiving the peg 61', and also with clearances 53' into which the individual conductors 11 of the multiwire lead 10 can be placed. The clearances are designed so as to be prolonged by moulded-on portions 54' on both sides, which portions project beyond the outer radius of the circular ring. Projections 55', which are bent over at right angles and can be inserted in corresponding clearances 28' inside the chambers 24' and which give rise to interlocking of the two parts 20' and 50', are provided at the ends of the moulded-on portions. For secure guidance of the individual conductors 11 above the eccentric pressure-applying face of the eccentric 63', the moulded-on portions 54' are designed so as to be prolonged to such an extent, on the side pointing towards the eccentric, that they terminate with the thickness of the disc of the eccentric. The through-aperture 3 through the hollow-cylinder part 20' is formed by two bores 25', 26' which differ in diameter and which form the offset 27'. The diameter of the bores 25', 26' is coordinated with the outer diameter of the peg 62' and also of the eccentric 63', whereas the diameter of the peg 61' is coordinated with the bore 51' in the circular ring element 50', so that the bores 25', 26' and 51' simultaneously serve as pivot bearings for the insert 60'. The offset serves as a bearing face for the insulation-cutting terminals of the contact elements 5, which terminals point towards the centre of the aperture. Provided underneath the insulation-cutting terminals are clearances 23' for the individual conductors 11, into which the latter are inserted when they are forced into the said insulation-cutting terminals 6 when the eccentric 63' is rotated. Assembly takes place in a similar manner to that in the variant previously discussed, in that the sheathing 12 of the multiwire lead 10 is removed at a suitable point, the individual conductors 11 are pulled apart in a fanned-out manner, and the insert 60', with the circular ring element 50' pushed on, is placed in the centre thus produced, the individual conductors being placed in the clearances 53' in the circular ring element. In the process, care must be taken to ensure that the eccentric is disposed with its smallest radial interval in the region of the clearances in the circular ring elements. Since the contact elements 5 are already disposed in the hollow-cylinder part 20', the multiwire lead is inserted, at a region which is still sheathed, in the aperture 3 through the slit 29', and then the combination of individual conductors which have been widened out over the eccentric and the circular ring element is pushed into the aperture in the part 20' as far as the stop. In the process, a closing piece 56' moulded onto the circular ring element closes the slit 29' present in the part 20'. A catching action between the part 20' and the circular ring element 50' is provided for in a perceptible and audible manner. As a result of that part of the peg 61' which projects out of the casing which has now been produced being rotated through the fact that a simple tool is placed in one of the transverse bores 64' and rotated in one direction, the individual conductors 11 are forced radially outwards, one after another, into the insulation-cutting terminals 6 of the individual contact elements. An electrical connection between the individual conductors 11 and additional electrical conductors 15 takes place as a result of the pushing of the electrical conductors 15, which have been provided with slip-on contacts, into the chambers 24' in the hollow-cylinder part 20' and onto those connecting ends 7 of the contact elements 5 which have been bent by 90°. (In that connection, see also FIG. 8.)

What is claimed is:

1. A connecting arrangement for connecting individual electrical conductors of a multiwire lead to circuit-extending electrical conductors, said connecting arrangement comprising:

an insulating casing which is formed from at least first and second parts that can be connected to one another;

a central aperture; and contact elements, for contact-making purposes, that are disposed inside the casing, said contact elements having insulation-cutting terminals, wherein said insulation-cutting terminals have apertures which open towards a center of the central aperture, said arrangement further comprising a rotatable, cylindrical insert having at least one peg on which an eccentric ring is constructed, wherein the individual conductors are disposed in the form of a circle around said insert in the axial direction and are pushed, together, into the central aperture of the connecting arrangement; and wherein when the cylindrical insert is rotated, the eccentric ring exerts a radially acting force on the individual conductors, causing the individual conductors to be forced into the apertures of the insulating-cutting terminals.

2. The connecting arrangement according to claim 1, wherein the first part of said casing comprises a cylindrical hollow cylinder having a longitudinal slit, and said second part of said casing comprises a circular ring element having a projection which can be inserted into the slit.

3. The connecting arrangement according to claim 1, wherein clearances into which the individual electrical conductors can be inserted are disposed in the form of a circle in the first part.

4. The connecting arrangement according to claim 1, wherein the central aperture comprises two bores of differing diameter, having an offset constructed thereon.

5. The connecting arrangement according to claim 1, wherein the second part of the casing, is constructed as a circular ring element having clearances which are formed from moulded-on portions that extend beyond an outer radius of a circular ring element, said clearances being adapted to engage in correspondingly shaped clearances in the first part.

6. The connecting arrangement according to claim 1, wherein the rotatable insert has pegs which differ in diameter.

7. The connecting arrangement according to claim 1, wherein the first and second parts of the casing are constructed as circular segments which are connected to one another and locked, into place together, said circular segments having end portions that point towards one another, said end portions including a guide and a lock.

8. The connecting arrangement according to claim 1, wherein freely rotatable circular ring elements are disposed on the pegs of the insert on either side of the eccentric ring.

9. The connecting arrangement according to claim 1, wherein a length of the peg is constructed in such a way that, after assembly of the insert, part of the peg projects out of the casing, and bores are provided in the outwardly projecting part.

10. The connecting arrangement according to claim 1, wherein peripheral clearances, in which the individual electrical conductors can be laid, are moulded into circular ring elements.

11. The connecting arrangement according to claim 1, wherein noses, which engage in clearances in a second part of the insulating casing, are moulded onto circular ring elements.

12. The connecting arrangement according to claim 1, wherein the parts of the insulating casing, which are constructed as circular segments, can be interlocked by means of a semicircular curved element that can be placed inside the central aperture, said curved element engaging in an undercut in the part.

13. The connecting arrangement according to claim 1, wherein a curved element and a first part have axially coinciding clearances which point towards the center of the central aperture.

14. The connecting arrangement according to claim 1, wherein the contact elements are fixed, in the form of a circle and at intervals, in depressions in a curved element.

15. The connecting arrangement according to claim 1, wherein the contact elements have insulation-cutting terminals and connecting ends are bent 90°.

16. The connecting arrangement according to claim 1, wherein connecting ends are held in chambers which are formed from mutually opposed clearances in one part of said casing and a semi-circular curved element, and additional electrical conductors can make contact with said connecting ends by means of slip-on contacts.

* * * * *